US008594555B2

(12) United States Patent
Herrmann

(10) Patent No.: US 8,594,555 B2
(45) Date of Patent: Nov. 26, 2013

(54) MEDIA REGISTRATION IN A DUPLEX PRINTING SYSTEM

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 247 days.

(21) Appl. No.: 13/095,139

(22) Filed: Apr. 27, 2011

(65) Prior Publication Data

US 2012/0272850 A1 Nov. 1, 2012

(51) Int. Cl.
*B41F 1/34* (2006.01)

(52) U.S. Cl.
USPC ..... 399/394; 399/388; 399/395; 400/188; 400/579; 400/580; 271/226; 271/227; 271/291

(58) Field of Classification Search
USPC ..... 399/388, 394, 395; 400/188, 579, 580; 271/291, 226, 227; 101/481
See application file for complete search history.

(56) References Cited

U.S. PATENT DOCUMENTS

| | | | | |
|---|---|---|---|---|
| 5,813,333 | A * | 9/1998 | Ohno | 101/181 |
| 6,957,888 | B1 * | 10/2005 | Currans | 347/107 |
| 6,993,275 | B2 * | 1/2006 | Mitsuya et al. | 399/301 |
| 7,021,214 | B2 * | 4/2006 | Kugo et al. | 101/485 |
| 7,177,585 | B2 * | 2/2007 | Matsuzaka et al. | 399/394 |
| 7,184,153 | B2 * | 2/2007 | Leonhardt | 358/1.12 |
| 7,394,475 | B2 * | 7/2008 | Bradley et al. | 347/116 |
| 7,509,068 | B2 * | 3/2009 | Honma | 399/82 |
| 7,616,918 | B2 * | 11/2009 | Jeon | 399/301 |
| 8,090,280 | B2 * | 1/2012 | Shim et al. | 399/49 |
| 8,301,048 | B1 * | 10/2012 | Boness et al. | 399/49 |
| 2005/0175386 | A1 * | 8/2005 | Romine | 400/579 |
| 2009/0285590 | A1 * | 11/2009 | Orsley | 399/46 |
| 2011/0126729 | A1 * | 6/2011 | Morono et al. | 101/481 |
| 2012/0090485 | A1 * | 4/2012 | Nitta et al. | 101/227 |

* cited by examiner

*Primary Examiner* — Ren Yan
*Assistant Examiner* — Quang X Nguyen

(57) ABSTRACT

Embodiments described herein are directed to registering media in a duplex printing system. A first side of a sheet of media is registered in a first pass in response to detection of a first end of the sheet. A registration marker is deposited on the sheet proximate to a second end of the sheet in the first pass. The registration marker can include a marking material that is in the non-visible light range. A second side of the sheet is registered in a second pass in response to detection of the registration marker deposited on the sheet.

7 Claims, 4 Drawing Sheets

MEDIA REGISTRATION IN A DUPLEX PRINTING SYSTEM

BACKGROUND

1. Technical Field

The presently disclosed embodiments are directed to duplex media registration in a printing system using media edge detection for registration in a first pass and registration marker detection in a second pass.

2. Brief Discussion of Related Art

Accurate duplex printing can be important to reduce or eliminate "show through," which refers to misregistration or misalignment between images printed on a first and second side of a sheet. For example, when a sheet is held up to a light the images should typically be registered from one side to the other so that the images are aligned. The misregistration between side one and side two printing can also be detectable when the sheets are used in book form and the facing pages are to be aligned (registered). The show through or misregistration of the second side can be a result of variation in paper cut tolerances, registration errors resulting from sensing of that edge and xerographic effects on the paper.

Typically, in duplex printing, media is registered in a first pass to facilitate printing on a first side of the media and is reregistered in a second pass to facilitate printing on a second side of the media. Some printing systems invert or flip the media end-over-end during duplex printing so that the end of the media that was the lead edge for printing on a first side of the media in the first pass becomes the trail edge for printing on a second side of the media in the second pass. Conventional printing systems that invert or flip the media between passes typically detect and register media using the same end of the media. For example, registration based on a lead edge of the media in the first pass, results in registration based on the trail edge in the second pass.

Duplex registration using the same end of the media is typically performed to reduce cut sheet errors. However, there are several issues with these conventional duplex registration schemes. As one example, edge sensors are typically distributed to detect trail edges of different sized sheets. For long sheets of media, such as sheets of about 26 inches in length, it may not be practical to have a trail edge sensor positioned to detect the trail edge. As another example, the trail edge of larger sized sheets of media can be in a curved baffle of the duplex return path while the lead edge can be in position to receive an image, which makes trail edge registration difficult. As another example, the printing process of some printing systems can change the length of the sheet and affect the calculated length from the trail edge to the lead edge. As yet another example, given the wide variety of media lengths being printed, the trail edge of sheets of media for second pass printing in duplex printing may not be sized to be timely and/or accurately detected by discretely and fixedly positioned trail edge sensors.

SUMMARY

According to aspects illustrated herein, there is provided a duplex printing system including a registration system and a duplex return. The registration system registers a first side of a sheet of media for printing in a first pass in response to detection of a first end of the sheet and registers a second side of the sheet for printing in a second pass in response to detection of a registration marker deposited proximate to a second end of the sheet. The registration marker facilitates detection of the sheet in proximity to a point of registration.

The printing station includes an image marking unit to print a first image on the first side of the sheet in the first pass and to print a second image on a second side of the sheet in the second pass. The duplex return transports the sheet to the registration system after printing in the first pass to facilitate printing in the second pass.

According to aspects illustrated herein, there is provided a media registration system for a duplex printing system. The media registration system includes an edge sensor, a registration marking unit, and a marking sensor. The edge sensor detects a first end of a sheet of media for registration of the sheet for side one printing in a first pass. The registration marking unit deposits a registration marker on the sheet proximate to a second end of the sheet in the first pass. The marking sensor detects the registration marker on the sheet for registration of a second side of the sheet for side two printing in a second pass.

According to aspects illustrated herein, there is provided a method of registering media in a duplex printing system. The method includes registering a first side of a sheet of media in a first pass in response to detection of a first end of the sheet, depositing a registration marker on the sheet proximate to a second end of the sheet in the first pass, and printing a first image on the first side of the sheet in the first pass based on the first end. The method further includes registering a second side of the sheet in a second pass in response to detection of the registration marker deposited on the sheet and printing a second image on the second side of the sheet in the second pass based on the registration markers. The registration marker facilitating detection of the sheet in proximity to a point of registration.

DETAILED DESCRIPTION

Figure 1:
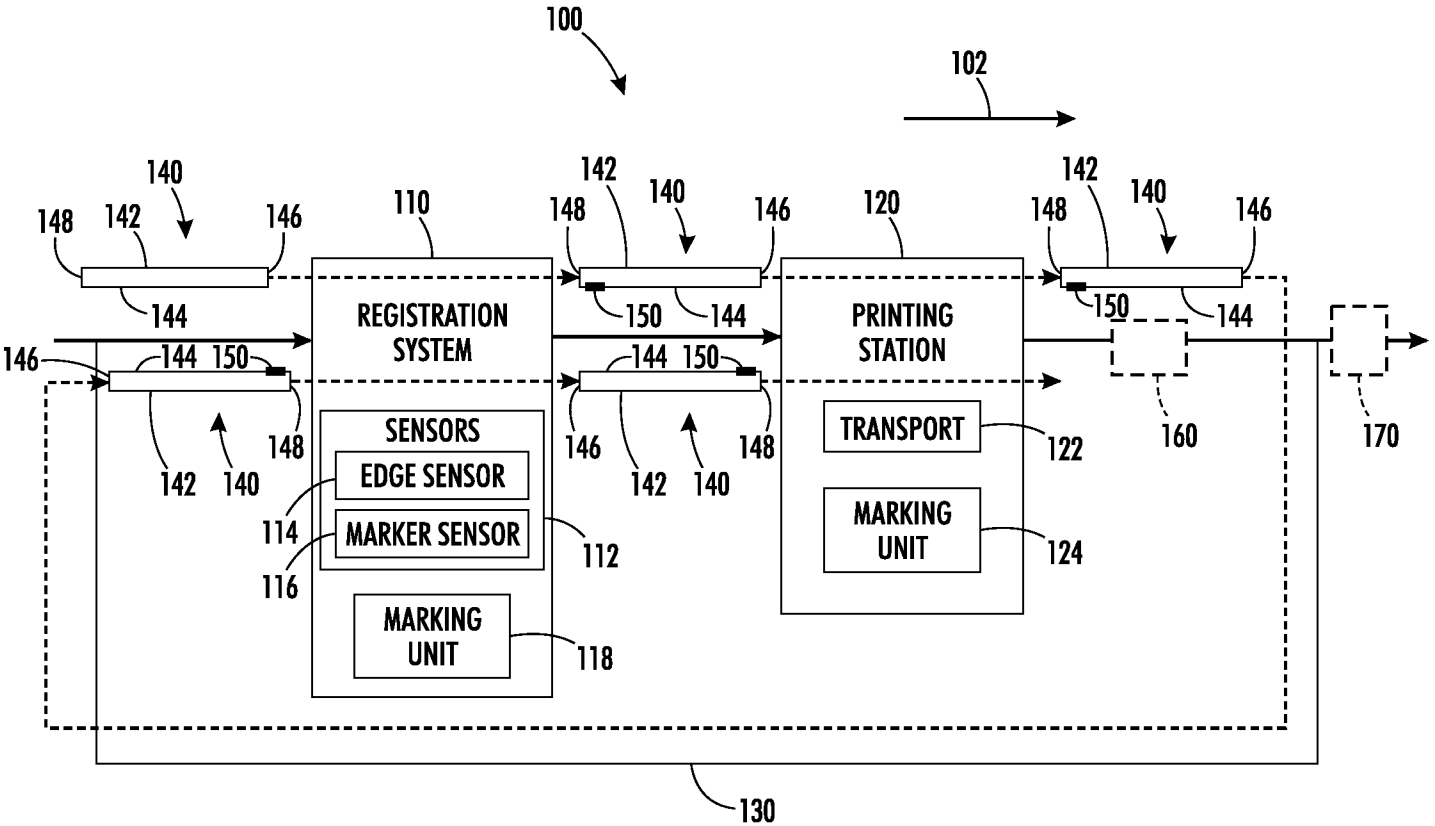
FIG. 1 shows a block diagram of an exemplary duplex printing system.

Exemplary embodiments are directed to duplex media registration using a first end of a sheet of media to register the first side of the sheet in a first pass and using a registration marker deposited proximate to a second end of the sheet to register the second side of the media in a second pass. Some embodiments can use a marking material in the non-visible light range, such as an ultra-violet and/or infrared marking material, to mark the media with registration markers or non-visible fiducials. Some embodiments can use a marking material in the visible light range, such as yellow, black, red, cyan, magenta, and/or blue marking material, to mark the media with registration markers or non-visible fiducials.

Embodiments can provide improved registration during side two printing. For example, embodiments can eliminate and/or reduce the use of media length calculations so that side two registration is independent of media sheet length. The registration markers disposed on the media can facilitate accurate alignment of images to be printed on first and second sides of the media.

By aligning a second side of the media using the registration markers, the upstream sensing location and media length variability found in conventional duplex registration systems can be removed, thereby reducing registration error. Using registration markers with non-visible characteristics provides a fiducial registration marking system that is transparent to use while providing an accurate registration target for duplex registration. Exemplary embodiments can deposit the registration markers on the second side of a sheet to an image printed on the first side of the sheet from obscuring the registration markers.

As used herein, "media" refers to a tangible medium, such as paper (e.g., a sheet of paper, a long web of paper, a ream of paper, etc.), transparencies, parchment, film, fabric, plastic, or other substrates on which an image can be printed or disposed.

As used herein, a "sheet" of media refers to a tangible medium having a generally planar form, which can be deformable, with two broad surfaces forming first and second sides and four edges forming ends of the medium.

As used herein, a "printing system" refers to a device, machine, apparatus, system, and the like, for printing on media and a "duplex printing system" refers to a printing system that can print on a first side of media in a first pass and a second side in a second pass.

As used herein, a "media registration system" or "registration system" refers to a system for aligning sheets of media for printing in a printing system in response to a reference location on the sheets.

As used herein, the terms "register" and "registration" refer to aligning media with respect to an image to be printed on the media.

As used herein, a "point of registration" refers to a location at which media registration occurs.

As used herein, a "registration marker" or "fiducial" refers to a reference deposited on media for use in registering the media.

As used herein, "deposit" refers to placing a registration marker on a sheet of media.

As used herein, "printing" refers to forming, building, generating, disposing, and the like, an image on a sheet of media using a marking material, such as ink or toner.

As used herein, "marking material" refers to a substance disposed on media. Some examples of marking material include "ink" or "toner". While ink is generally stored in a liquid form and toner is generally stored in a solid form, ink and/or toner can be stored in various forms. For example, ink can be stored in a liquid form or a solid form.

As used herein, "non-visible light range" refers to portions of the light spectrum that is outside of visible light, such as electromagnetic radiation having a wavelength that is outside the range of about $4.3\times10^{14}$ HZ to about $7.5\times10^{14}$ Hz. Examples of light in the non-visible light range include infrared and ultraviolet radiation.

As used herein, "marking material in the non-visible light range" refers to a marking material having characteristics and/or properties such that the marking material is generally not visible.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics or parameters in a printing system, such as a belt and or substrate media location, position, speed, orientation, process or cross-process position, and the like.

As used herein, an "edge sensor" refers to a sensor for detection an edge of a sheet of media.

As used herein, a "marker sensor" refers to a sensor for detection of registration markers deposited on a sheet of media.

As used herein, "detecting" refers to identifying, discovering, or recognizing the presence or lack thereof of an object or thing, such as the presence of a sheet of media or a registration marker.

As used herein, "process direction" refers to a direction in which media is processed through a printing system and/or registration system and "cross-process direction" refers to a direction substantially perpendicular to the process direction.

As used herein, "upstream" and "downstream" refer to locations of objects or things relative to a location of another object or thing with respect to the process direction, wherein an object is downstream from another object when it is further in the process direction than the other object and an object is upstream from another object when the other object is further in process direction than the object.

As used herein, "proximate" refers to being close or near.

As used herein, a "lead edge" refers to an edge of a sheet of media that is further downstream than the remainder of sheet and a "trail edge" refers to an edge of a sheet of media that is further upstream than the remainder of the sheet.

As used herein, "skew" refers to a position of an object or thing with respect to a reference line or surface where the object or thing is neither perpendicular nor parallel to the reference line or surface. For example, media can be skewed when a leading edge of substrate media is not substantially parallel to a cross-process direction.

As used herein, "deskewing" refers to a process of removing skew.

As used herein, "relative" refers to being considered in comparison, determined based on another object or thing, and the like.

As used herein, an "image" refers to a visual representation, reproduction, or replica of something, such as a visual representation, reproduction, or replica of the contents of a computer file rendered visually on a belt or substrate media in a printing system. An image can include, but is not limited to: text; graphics; photographs; patterns; pictures; combinations of text, graphics, photographs, and patterns; and the like.

As used herein, "transporting" refers to carrying and/or moving an object or thing, such as an image or media, from location to another location.

As used herein, a "printing station" refers to a section in a printing system that disposes, transfers, forms, or otherwise generates an image on a substrate media using an image marking unit.

As used herein, a "marking unit" is a device or apparatus for depositing or printing a marking material onto a sheet of media, a "image marking unit" refers to a marking unit that prints images on a sheet of media, and a "registration marking unit" refers to a marking unit that deposits registration markers on a sheet of media.

As used herein, a "duplex return" refers to a media transport that receives a sheet of media at an output, such as an output of the printing station and transports to an input, such as an input of a media registration system to facilitate a transition between a first pass and a second pass.

As used herein, a "first pass" refers to the first time a sheet of media is processed by a registration system and/or a printing system and a "second pass" refers to the second time the sheet of media is processed by the registration system and/or the printing station.

FIG. 1 shows a portion of an exemplary duplex printing system 100 (hereinafter "printing system 100") that includes a duplex media registration system 110 (hereinafter "registration system 110"), a printing station 120, and a duplex return 130. The printing system 100 can be implemented to process media in a process direction 102 through the registration system 110 and the printing station 120 in a first pass so that an image can be printed on a first side of the media. The printing system 100 can further be implemented to transport the media back to an input of registration system 110 via the duplex return 130 so that the media is processed in the process direction 102 through the registration system 110 and the printing station 120 in a second pass to print on a second side of the media. The media can be registered on each pass to ensure that proper media position/alignment before images are printed on the media.

The registration system 110 can include sensors 112 and a registration marking unit 118 (hereinafter "marking unit 118"). The sensors 112 can include a sensor 114 to detect the presence of media in the registration system 110. For example, the sensor 114 can be configured as a media edge sensor that detects an edge of the media, such as a lead edge, as the media is transported through the registration system 110. The sensors 112 can also include a marker sensor 116 to detect registration markers or non-visible fiducials disposed on the media as the media passes through the registration system 110. Detection of an edge of the media and/or a registration marking on the media can be used by the registration system 110 to deskew and/or position/align the media in preparation for printing of an image as the media passes through the printing station 120. In some embodiments, detection of an edge of the media and/or markings on the media can be used to determine the timing with which marking material is disposed on the media.

The marking unit 118 can dispose registration markers on the media to register the media for side two printing. The marking unit 118 can be positioned opposite of the sensors 112 such that the sheets of media pass between the sensors 112 and the marking unit 118. In some embodiments, the registration markers can be formed using a marking material that is in the non-visible light range, such as, for example, marking material visible in the ultra violet (UV) and infrared (IR) light ranges. Using non-visible marking material to form the registration markers permits printing of the registration markers without affecting the quality of the prints. In some embodiments, the registration markers can be formed using a marking material that is in the visible light range, such as, for example, marking materials having colors of yellow, black, cyan, and the like.

The printing station 120 can be implemented for direct marking printing (e.g., Direct-to-Paper or Image-on-Paper printing), modular overprint press (MOP) printing, xerographic-based printing, electrostatic-based printing, ink jet printing, laser printing, solid ink printing, and the like. The printing station 120 can include a transport 122 and one or more marking units 124. The transport 122 can include at least one of belts, rollers or nips, platens, and/or other devices or structures for transporting media through the printing station 120.

The one or more image marking units 124 can dispose a marking material on media. In some embodiments, the marking units 124 can be implemented using an intermediate transfer belt or drum onto which an image is disposed before being transferred to the substrate media. The image can be transferred from the intermediate transfer belt or drum to the substrate media as the substrate media passes the printing station. In some embodiments, the marking units 124 can be implemented as one or more print heads that eject a marking material directly on media as the media passes through the printing station 120.

In the present embodiment, a sheet 140 of media having a first side 142 and a second side 144 is transported through the system 110 in the process direction 102 so that a first end 146 of the media is a lead edge in the first pass and the first side of the sheet faces in a direction for receiving an image from the marking units of the printing station 120. The sheet 140 of media enters the registration system 110 with the first end 146 leading the sheet 140. The registration system 110 can be configured to register the sheet 140 based on detection of the lead edge, first end 146, by the sensor 114 so that the sheet 140 can be deskewed and position/aligned in preparation for side one printing by marking units 124 of the printing station 120. As the sheet 140 moves through the registration system 110, the marking unit 118 disposes registration markers on the media to be used to register the media for side two printing in the second pass. The registration markers can be disposed on the media towards a second end 148 of the media.

In some embodiments, the timing with which the printing is performed by the marking units 124 can be determined based on detection of the leading edge by the registration unit 110. After an image is printed on the first side 142 of the sheet 140, the sheet 140 can be routed back to the input of the registration system 110 for side two printing via the return path 130. The sheet 140 can be inverted or flipped for side two printing so that the sheet 140 is rotated 180 degrees about its width. As a result, the second end 148 of the sheet becomes the lead edge of the sheet 140 in the second pass and the second side 144 of the sheet 140 faces in a direction for receiving an image from the printing station 120.

In the second pass, the sheet 140 of media passes through the registration and the registration markers are detected by the sensor 116. The registration system 110 can be configured to register the second side of the sheet 140 based on detection of the registration markers disposed at the second end 148 of the media, which is now the lead edge of the media, so that the sheet 140 can be deskewed and position/aligned in preparation for side two printing by marking units 124 of the printing station 120.

Embodiments of the printing system 100 can also include post processing components 160 and 170. The components 160 can include a leveler, spreader, curing unit, and the like, which can process the media before being returned to the registration system for the second pass. The components 170 can include, for example, a finisher, which can process the media after side one and side two printing.

Figure 2:
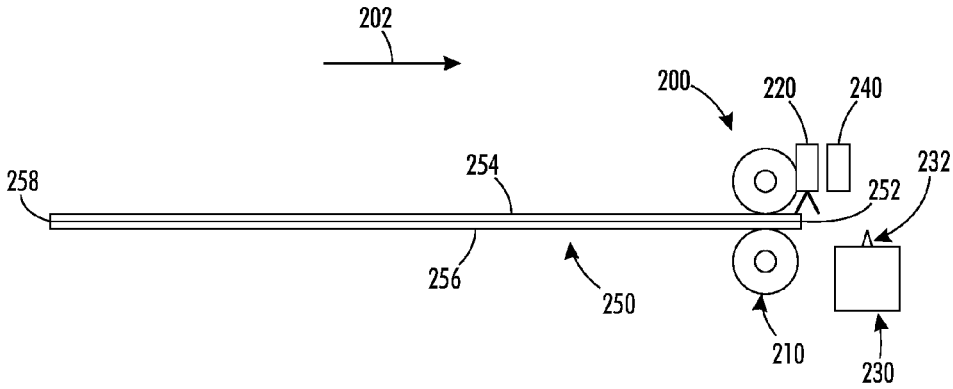
FIGS. 2-4 show an exemplary duplex media registration system.
Figure 3:
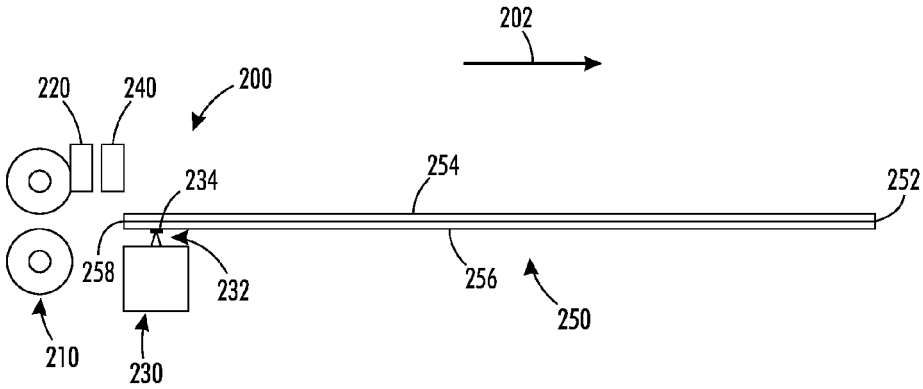
Figure 4:
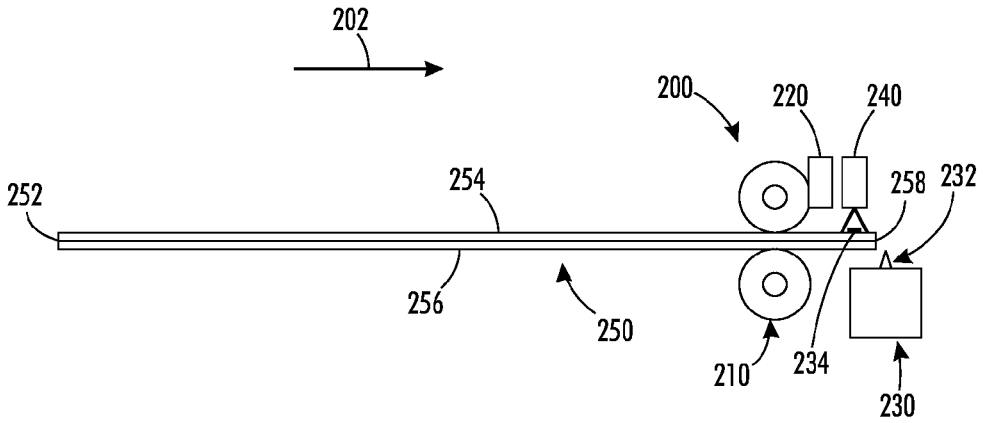

FIGS. 2-4 show a portion of an exemplary registration system 200 that can be implemented as one embodiment of the registration system 110 (FIG. 1). FIGS. 2 and 3 illustrates processing a sheet 250 of media passing through the registration system 200 in a first pass and FIG. 4 illustrates processing the sheet 250 of media passing through the registration system 200 in a second pass. The registration system 200 can include a registration nip 210, a media edge sensor 220, a registration marking unit 230, and a marker sensor 240. The registration nip 210 can urge a sheet 250 of media through the registration system 200 in a process direction 202.

The edge sensor 220 can detect a first end 252 of the sheet 250 in a first pass to register a first side 254 of the sheet 250 for printing. In the present embodiment, the edge sensor 220 is disposed above the sheet 250 as the sheet passes through the registration system so that the first side 254 of the sheet 250 faces towards the edge sensor 220 and a second side of the sheet 256 faces away from the edge sensor 220. In some embodiments, the edge sensor 220 can be a reflective-type sensor that transmits electromagnetic radiation toward a surface of the sheet 250 as the sheet passes the edge sensor 220.

For embodiments in which the edge sensor 220 is a reflective-type sensor, if the electromagnetic radiation is not reflected back to the edge sensor 220, the sheet 250 is not within a detection range of the edge sensor 220 and is not detected. However, if the electromagnetic radiation is reflected by the sheet 250, the reflected electromagnetic radiation is received by the edge sensor 220 and the sheet is detected. Therefore, as the sheet 250 is urged in the process direction 202, the first end 252, which is the lead edge in the first pass, passes by the edge sensor 220, which identifies an edge transition based on the detection of the sheet 250.

The registration marking unit 230 can have print head 232 to deposit one or more registration markers 234 (e.g., non-visible fiducials) (FIG. 3) on the sheet 250. The registration marking unit 230 can be implemented as a UV/IR marking unit configured to deposit registration markers 234 in the non-visible light range, such as in the ultra-violet or infrared light range. In the present embodiment, the registration marking unit 230 can be positioned below the sheet 250 as the sheet passes through the registration system 200 so that the second side 256 of the sheet 250 face towards the registration marking unit 230 and the first side 254 of the sheet 250 faces away from the registration marking unit 230.

As the sheet 250 continues in the process direction 202 in the first pass, the print head 232 of the registration marking unit 230 can deposit the registration markers 234 on the second side 256 of the sheet towards and proximate to a second end 258 of the sheet 250. Printing registration markers on the second side of the sheet allows the registration markers to be visible to the registration system during registration of the second side even after an image has been printed on the first side. The location at which the registration markers 234 can be deposited can be based on the detection and/or registration of the first end 252 of the sheet by the edge sensor 220 so that the registration markers 234 can be deposited relative to the first end 252 of the sheet. The registration markers can be deposited at the second end of the sheet so that second side registration can be performed when the second end of the sheet is near the registration nip 210, such that the second end of the sheet is under control of the registration system when the registration markers are detected. This allows detection of a position of the sheet in proximity to the point of registration.

As shown in FIG. 4, the marker sensor 240 can detect the registration markers 234 deposited on the sheet 250 in the second pass to register the second side 256 of the sheet 250 for printing. In the present embodiment, the marker sensor 240 is disposed above the sheet 250 as the sheet passes through the registration system 200 so that, in the second pass, the second side 256 of the sheet 250 faces towards the marker sensor 240 and the first side 254 of the sheet 250 faces away from the marker sensor 240. In some embodiments, the marker sensor 220 can be a reflective-type sensor that emits electromagnetic radiation toward a surface of the sheet 250 as the sheet passes the marker sensor 240. The marker sensor 240 can be configured to detect the registration markers 234, but not the sheet 250 on which the registration markers 234 are disposed.

For embodiments in which the marker sensor 240 is a reflective-type sensor, if the electromagnetic radiation is not reflected back to the marker sensor 240, one or more of the registration markers 234 are not within a detection range of the marker sensor 240 and are not detected. However, if the electromagnetic radiation is reflected by one or more of the registration markers 234, the reflected electromagnetic radiation is received by the marker sensor 240 and the registration markers are detected. Therefore, as the sheet 250 is urged in the process direction 202, the second end 258, which is the lead edge in the second pass, passes through the registration system 200 and the marker sensor 240 detects the registration markers 234 on the sheet 250 to register the second side 256 of the sheet 250 for printing.

Figure 5:
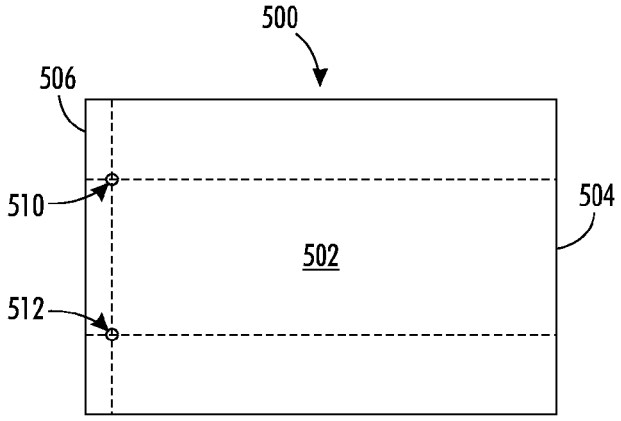
FIG. 5 shows exemplary registration markers deposited on a sheet of media.

FIG. 5 shows a second side 502 of an exemplary sheet 500 of media having a first end 504 and a second end 506 with registration markings 510 and 512 deposited by the marking unit of the registration system. The registration markers 510 and 512 can include strips, dashes, dots, or other patterns deposited on the sheet 500 of media. For example, registration markers 510 and 512 can form two dashes or dots on the second side 502 of the sheet 500 towards and proximate to the second end 506 of the sheet 500. The registration markers 510 and 512 can be spaced linearly and aligned in the cross process direction so that the registration markers 510 and 512 can be used to register and/or deskew the sheet 500 of media. For example, when the sheet is being registered for side two printing, the marker sensor can detect the registration markers 510 and 512, where detection of one of the markers before the other marker can indicate that the sheet 500 of media is skewed. In some embodiments, the registration markers 510 and/or 512 can be formed using a marking material in the non-visible light range. In some embodiments, the registration markers 510 and/or 512 can be formed using a marking material in the visible light range.

Figure 6:
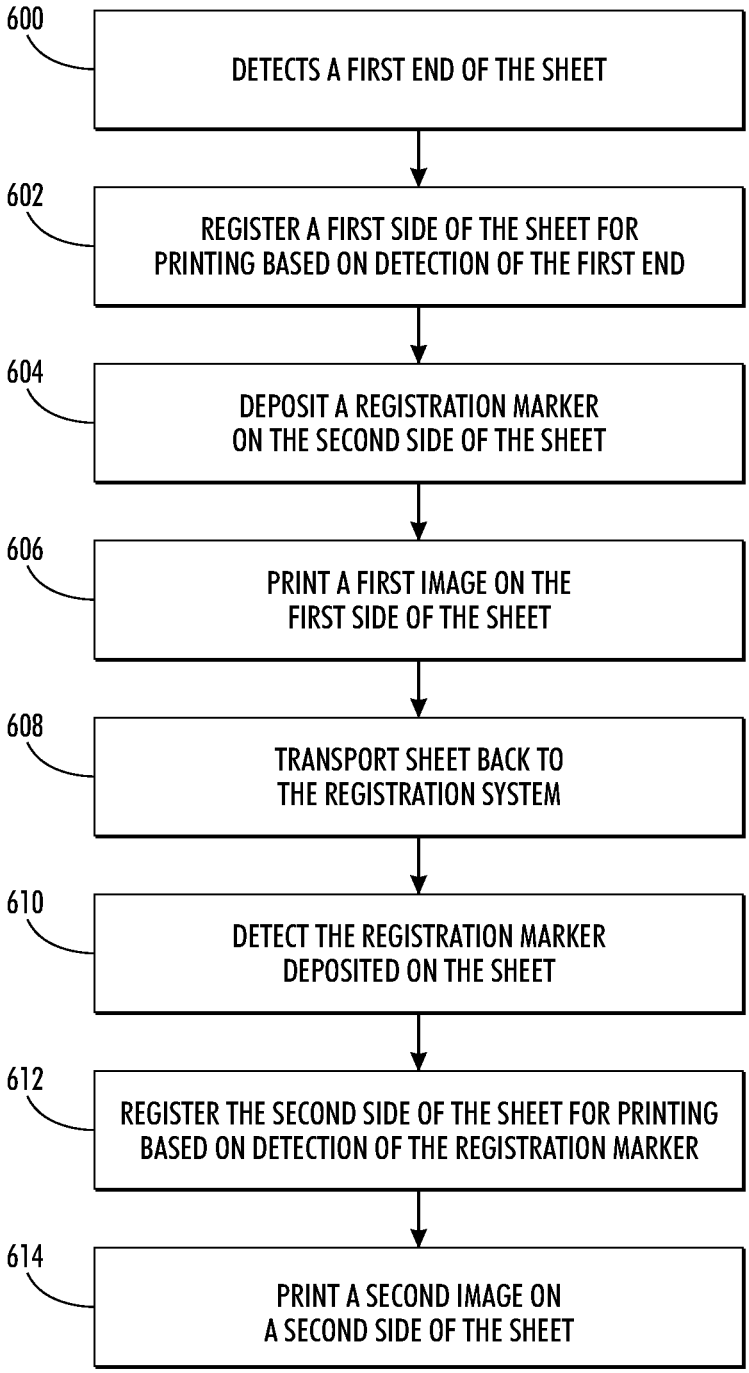
FIG. 6 is a flowchart illustrating an exemplary duplex media registration process.

FIG. 6 is a flowchart illustrating an exemplary media registration process implemented in a duplex printing system. In a first pass, the registration system receives a sheet of media having two sides on which images can be printed. The registration system detects a first end of the sheet as the sheet is transported in the process direction through registration system (600) and registers a first side of the sheet for printing based on detection of the first end (602). The sheet continues in the process direction and the registration system deposits a registration marker on the second side of the sheet towards and proximate to a second end of the sheet opposite the first end (604). The sheet is transported through the printing station of a duplex printing system and a first image is printed on the first side of the sheet (606). Subsequently, the sheet is transported back to the registration system via a duplex return for side two printing in a second pass (608). The duplex return can invert the sheet of media by flipping the sheet end-over-end so that the first end of the media, which was the lead edge in the first pass is the trail edge in the second pass and so that the second side of the media which faced towards the registration marking unit, faces towards the sensors.

In the second pass, the registration system can detect the registration marker deposited on the sheet of media during the first pass (610) and can register the second side of the sheet for printing based on detection of the registration marker (612). The sheet is transported through the printing station and a second image is disposed on a second side of the sheet (614). The second image can cover over the registration markers deposited on the second side of the sheet.

By printing non-visible fiducials on the media prior to the printing processes, the registration of the second side of the sheet can be accomplished using the registration markers or fiducials printed on the second side of the sheet after registration of the first side of the sheet. By detecting the actual location of the fiducials during duplex registration, the registration sensing can use the registration markers rather than a trailing edge and associated media length calculation to register the sheet. Embodiments address the issues identified with current techniques for registering duplex sheets and allows for detection of the sheet position for side two printing at or near the point of registration rather than having to extrapolate from the sheet's trailing edge sensed upstream of the registration system.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A duplex printing system for printing on a first side and a second side of a sheet of media in a first pass and a second pass, respectively, the system comprising:

a registration system comprising:

an edge sensor to detect a first end of the sheet of media in the first pass;

a registration marking unit that deposits at least two registration markers on a second side of the sheet in the first pass;

a marker sensor that detects at least two of the at least two registration markers in the second pass; and a registration nip for positioning the sheet of media, wherein the first side of the sheet of media for printing is registered in a first pass in response to detection of the first end of the sheet, wherein the second side of the sheet for printing in a second pass is registered in response to detection of at least two of the at least two registration markers deposited proximate to a second end of the sheet, the at least two registration markers facilitating detection of the sheet in proximity to a point of registration, and wherein the marker sensor detects the position of the at least two registration markers to detect a skew in the sheet of media prior to second side printing and the registration nip deskews the sheet of media;

a printing station having an image marking unit to print a first image on the first side of the sheet in the first pass and to print a second image on the second side of the sheet in the second pass; and a duplex return to transport the sheet to the registration system after printing in the first pass to facilitate printing in the second pass.

2. The system of claim 1, wherein the registration system deposits the at least two registration markers on the sheet in the first pass.

3. The system of claim 2, wherein the registration system deposits the at least two registration markers on the second side of the sheet.

4. The system of claim 1, wherein the at least two registration markers is a marking material in a non-visible light range.

5. The system of claim 1, wherein the first end of the sheet is a lead edge in the first pass and the second end of the sheet is lead edge in the second pass.

6. The system of claim 1, wherein the duplex registration system deposits a plurality of registration markers on the sheet, the plurality of registration markers being used by the registration system to deskew the sheet of media in the second pass.

7. The system of claim 1, wherein the duplex return inverts the sheet of media between the first pass and the second pass.

* * * * *